United States Patent [19]

Segal

[11] Patent Number: 4,479,733

[45] Date of Patent: Oct. 30, 1984

[54] DUAL-FUNCTION LOOSELEAF BINDER SHEETS

[75] Inventor: Leonard Segal, Lakeville, Conn.

[73] Assignee: The Dotty Smith Corporation, Lakeville, Conn.

[21] Appl. No.: 453,579

[22] Filed: Dec. 27, 1982

[51] Int. Cl.[3] ..... B42F 3/00

[52] U.S. Cl. ..... 402/79; 281/2; 281/5; 402/80 R; 402/501

[58] Field of Search ..... 281/2, 5, 21-A, 23, 281/25 A, 38; 283/62, 66 R; 402/19, 79, 80 R, 500, 501

[56] References Cited

U.S. PATENT DOCUMENTS 915,789 3/1909 McComb ..... 402/79

1,687,859 10/1928 Fontaine ..... 402/500

2,831,538 4/1958 Lishman ..... 402/80 R X 3,315,683 4/1967 Rodriguez et al. ..... 402/500

FOREIGN PATENT DOCUMENTS 2408108 8/1975 Fed. Rep. of Germany ..... 402/500

*Primary Examiner*—Paul A. Bell

*Attorney, Agent, or Firm*—Mattern, Ware, Stoltz & Fressola

[57] ABSTRACT

This invention relates to looseleaf binder sheets, and more particularly to looseleaf binder sheets having the capability of being both securely retained in the binder from removal in response to forces acting in one direction, while also being easily removed against the binder when withdrawn in an alternate direction.

8 Claims, 11 Drawing Figures

DUAL-FUNCTION LOOSELEAF BINDER SHEETS

BACKGROUND ART

Due to the flexibility provided by looseleaf binders, such binders and replacement sheets for these binders have become very popular for both school and business use. However, although looseleaf binders and looseleaf binder sheets have existed for many years, one problem that has remained unsolved is the inability of the looseleaf binder sheets to be both securely retained in the binder, while also being easily removed and subsequently reinserted without causing any ripping or tearing of the sheet of paper and without having to open the binder.

Although the desire to remove and replace individual sheets of paper in looseleaf binders without opening the binder and without tearing the edges of the sheet has always existed, the requirement that the looseleaf sheets be securely retained has been the dominant objective to which prior art patents have been directed. As a result, these prior art inventions and products teach reinforcing tabs, inserts, or liners, all of which are constructed to enhance the strength of the looseleaf sheet of paper in the area about the binder-receiving holes, in order to assure secure retention of the sheets by the binding posts or rings. Such systems are taught in U.S. Pat. Nos. 915,789 and 3,315,683. However, these prior art systems do not enable the user to remove any sheet from the binder without either opening the binder or ripping the sheet.

Consequently, the principal object of the present invention is to provide pre-punched sheets for looseleaf binders wherein each sheet is capable of being securely retained in the binder, free from accidental, unwanted dislodgement or removal, while also being freely removable from the binder without opening the binder and without permanently damaging the sheets of paper.

Another object of the present invention is to provide sheets of looseleaf paper having the characteristic features described above which is capable of being removed quickly and easily as well as repeatedly, without causing any degradation of the holding system.

Another object of the present invention is to provide sheets for looseleaf binders having the characteristic features described above which also incorporates edge reinforcements to further enhance the structural integrity and longevity of the dual-function sheets.

Other and more specific objects will in part be obvious and will in part appear hereinafter.

DISCLOSURE OF THE INVENTION

With the present invention, the prior art drawbacks are all overcome and eliminated and a unique construction for looseleaf binder sheets is achieved. The looseleaf binder sheets of this invention incorporate at least two layers of sheet material about each fastening or binder-receiving hole of the paper sheets with each layer incorporating flexible, binder locking fingers between the side edge of the paper and each binder-receiving hole, thereby creating at least two flexible, overlying binder-locking fingers directly adjacent each binder-receiving hole.

Furthermore, these overlying binder-locking fingers are constructed with their respective terminating ends offset from each other, thereby achieving a cooperating, overlapping, juxtaposed construction, which provides interlocking engagement of the sheet of paper in the binder to prevent withdrawal of the sheet from the binder in response to forces acting radially on the binder-receiving holes of the paper sheet or primarily in the plane of the sheet. However, when forces are applied to a paper sheet which forces are not in the plane of the sheet and, instead, are either acting axially to the binder-receiving holes or at an acute angle thereto, the flexible, binder-locking fingers are bent and displaced relative to each other, allowing the sheet of paper to be withdrawn from the binder, quickly and easily without permanently damaging the sheet of paper or requiring the binder to be opened. As a result, a dual-function looseleaf binder sheet is achieved.

In the preferred embodiment, the paper sheet of the present invention incorporates a single elongated reinforcing strip which is securely fastened to the side edge of the sheet of paper, providing a twin layer reinforced area about each of the binder-receiving holes, while only requiring a single additional component. However, if desired, separate overlying reinforcing segments can be affixed about each binder-receiving hole in order to achieve the overlapping, flexible, binder-locking finger construction of the present invention.

In the preferred embodiment, two overlying flexible, binder-locking fingers are employed and have been found to provide the desired secure retaining engagement with the binder in response to forces acting radially about the binder-receiving holes, as well as the desired quick and easy removal of the sheets in response to forces acting along the central axis of the binder-receiving holes or the forces at acute angles thereto. However, if desired, three or more layers could be employed without departing from the scope of this invention.

The invention accordingly comprises an article manufactured possessing the features, properties and relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

BEST MODE FOR CARRYING OUT THE INVENTION

Figure 1:
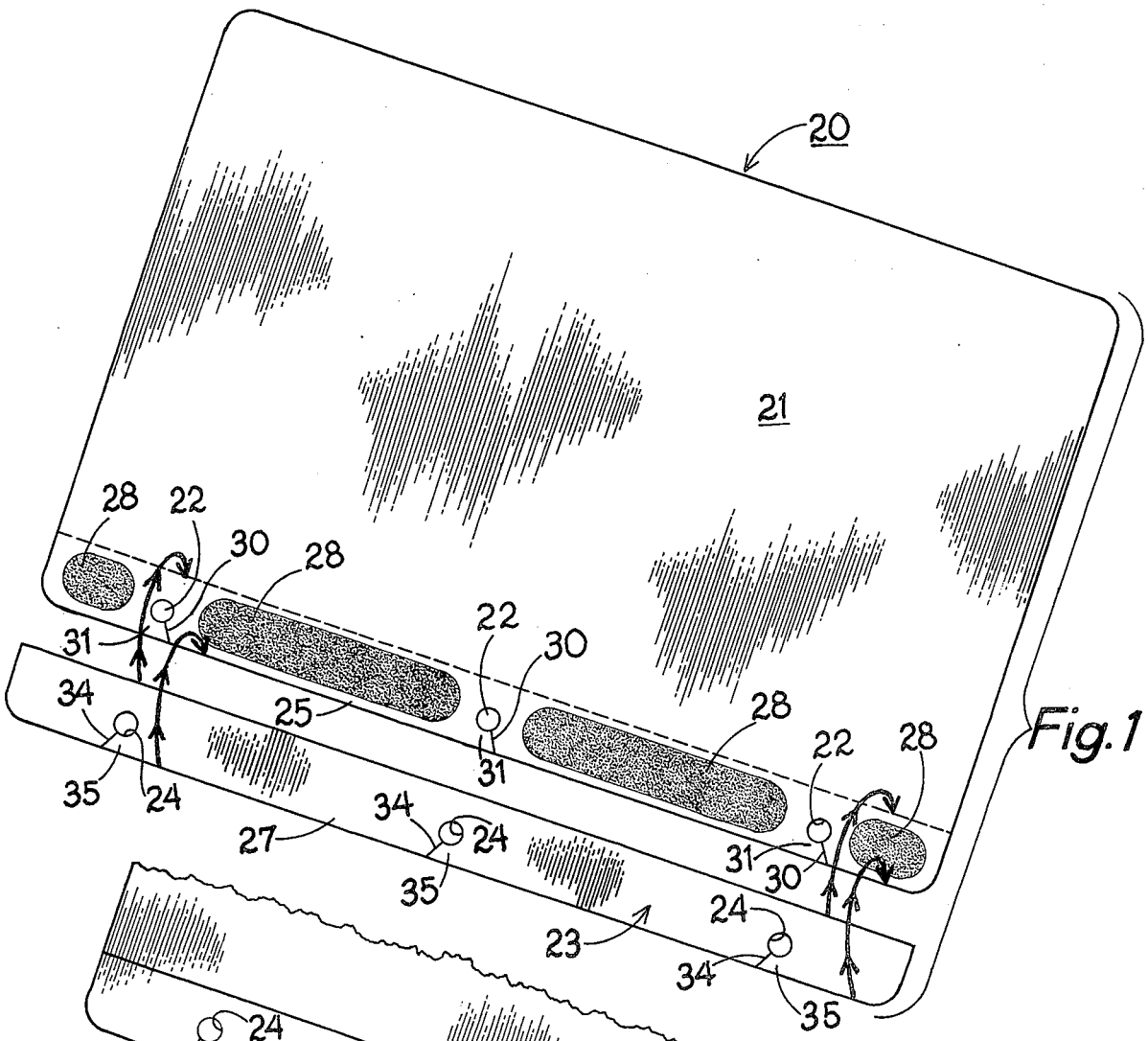
FIG. 1 is an exploded top plan view of the dual-function, looseleaf binder sheet of the present invention.

In FIG. 1, the preferred embodiment of dual function, looseleaf binder sheet 20 of the present invention is shown. In this preferred embodiment, looseleaf binder sheet 20 comprises a conventionally-sized paper sheet 21 having a side edge 25 and three binder-receiving holes 22 formed therein inwardly along side edge 25. In addition, dual function, looseleaf binder sheet 20 incorporates an elongated, continuous, reinforcing strip 23 having a side edge 27 and three binder-receiving holes 24 formed therein inwardly of side edge 27. Also, paper sheet 21 incorporates a plurality of bonding zones 28 positioned between holes 22 for secure bonded engagement with reinforcing strip 23 when strip 23 is positioned in overlying engagement therewith.

Paper sheet 21 also incorporates slits 30 which, in the embodiment shown in FIG. 1, extend radially from each binder-receiving hole 22 to side edge 25 of paper sheet 21. As will be more fully described below, each slit 30 establishes a flexible binder locking finger 31 between each binder-receiving hole 22 and terminating side edge 25.

In a similar construction, elongated strip 23 incorporates slit 34 radially extending from each binder-receiving hole 24 to terminating side edge 27 of strip 23. As with slits 30, slits 34 establish a flexible, binder-locking finger 35 between each binder-receiving hole 24 and edge 27 of elongated strip 23. In the preferred construction shown in FIG. 1, each slit 34 joins side edge 27 at an acute angle thereto. Preferably, slits 34 have a direction of slope which is opposite to the direction of slope of slits 30. In this way, binder-locking fingers 31 and 35 have terminating edges on opposite sides of binder-receiving holes 22 and 24 and are capable of being assembled into cooperating pairs having an interactive, overlapping construction.

In order to complete the construction of the dual function, looseleaf binder sheet 20 of the present invention, strip 23 is securely bonded along the side edge of paper sheet 21 with binder-receiving holes 24 and 22 being concentrically axially aligned. Although strip 23 can be bound to paper sheet 21 in a plurality of alternate constructions, it has been found that the use of fastening means such as glue positioned along the side edge of paper sheet 21 in fastening zones 28 between holes 22 provides the desired secure affixation of strip 23 to paper sheet 21.

Once strip 23 has been securely affixed to paper sheet 21, the construction of dual function, looseleaf binder sheet 20 of the present invention is completed. As is fully detailed below, the creation of two cooperating, juxtaposed, overlapping, flexible, binder locking fingers 31 and 35 positioned between each of the aligned binder-receiving holes 22 and 24 on one side thereof, and the aligned terminating edges 25 and 27 on the other side thereof, looseleaf binder sheet 20 is achieved. With this construction, looseleaf binder sheet 20 is securely retained in a binder, preventing withdrawal thereof in response to forces acting in the plane of the sheet, while also being quickly and easily withdrawn from the binder, without ripping of the sheet or opening of the binder, in response to the forces acting substantially perpendicular to the plane of looseleaf binder sheet 20 or at an acute angle from these perpendicular forces.

Figure 2:
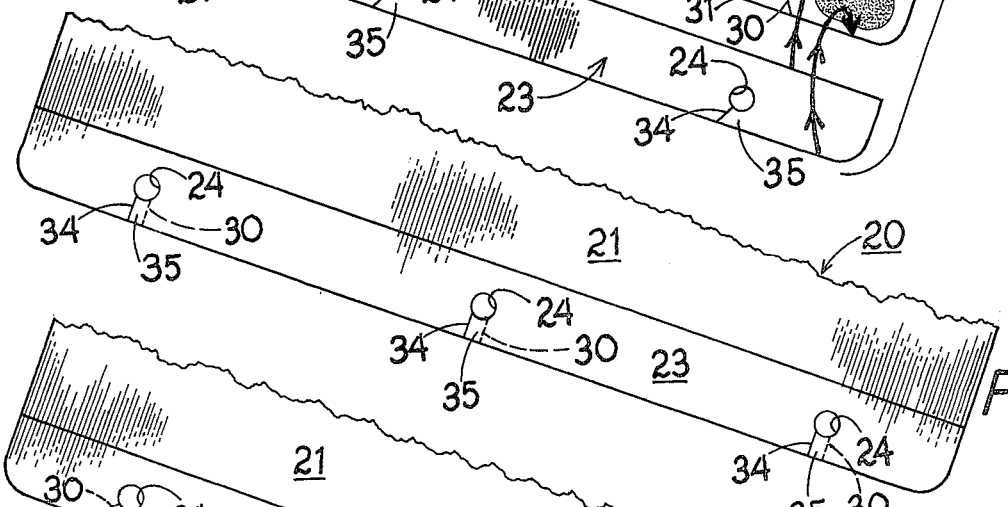
FIGS. 2 and 3 are top plan views, partially broken away, showing alternate embodiments for the dual-function, looseleaf binder sheets of the present invention.
Figure 3:
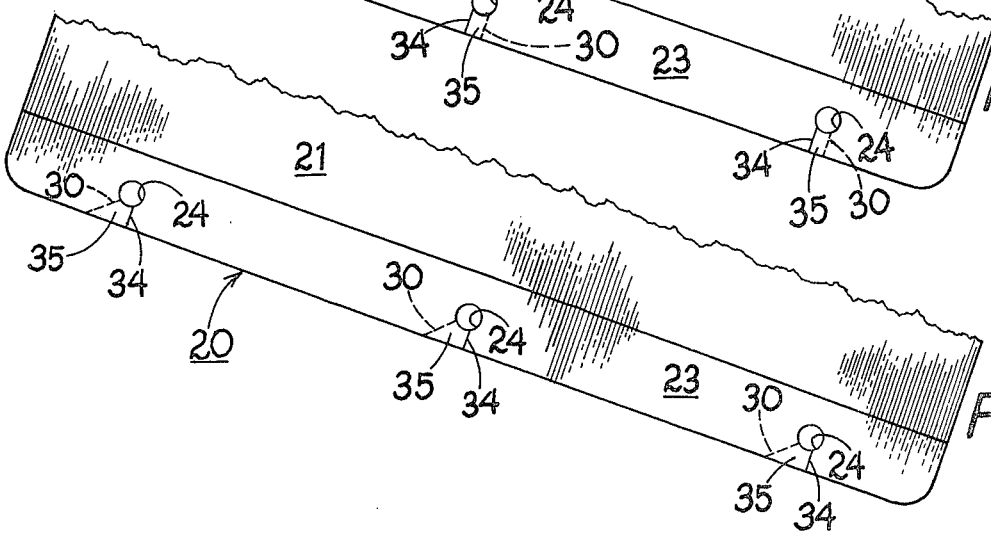

In FIGS. 2 and 3, two alternate embodiments of the present invention are shown. In these embodiments, elongated strip 23 and paper sheet 21 incorporate alternate slit configurations.

In FIG. 2, slits 34 of elongated strip 23 is depicted substantially perpendicular to side edge 27 and extending therefrom to binder-receiving holes 24 at a position almost tangential therewith. Similarly, slits 30 of sheet 21 extends substantially perpendicularly from side edge 25 of sheet 21 to binder-receiving holes 22, which are concentrically aligned with holes 24 of strip 23, with each slit 30 joining concentrically aligned binder-receiving holes 22 of sheet 21 at a point substantially tangential to holes 22 and at a position opposite slit 34. In this way, flexible binder-locking fingers 31 are created on sheet 21 which are in juxtaposed underlying cooperating relationship with flexible binder locking fingers 35 of strip 23.

In FIG. 3, a similar dual-function, looseleaf binder sheet configuration is shown wherein slits 34 of elongated strip 23 extends substantially perpendicularly from edge 27 to binder-receiving holes 24, as described above in FIG. 2, while slits 30 of sheet 21 extends at a sloping angle between concentrically aligned binder-receiving holes 22 to terminating edge 25 in a substantially identical manner as described above in reference to FIG. 1. In this configuration, although the angles of slits 30 and 34, in relationship to the side edges, are not substantially identical, an operatively identical construction is achieved with overlying, flexible, binder-locking fingers 35 and 31 being created in order to achieve the dual function locking and removal construction of this invention.

By referring to FIGS. 1, 2 and 3, it is readily apparent that many alternate constructions and arrangements for the present invention can be employed without departing from the scope of this invention. In particular, any multi-layer configuration which achieves a plurality of juxtaposed, overlying, cooperating, flexible, binder-locking fingers positioned between the binder-receiving holes and the side edge of the looseleaf sheet would provide an operative looseleaf binder sheet incorporating this invention.

In FIGS. 4–7, sequential views of the operation of the flexible binder-locking fingers are shown as the dual-function, looseleaf binder sheet 20 of the present invention is inserted onto a ring binder for secure retained engagement therewith. FIGS. 8–11 represent similar sequential insertion steps, with looseleaf binder sheet 20 viewed from an alternate position. In order to clearly depict the insertion and engagement process of the cooperating, overlapping, flexible, binder-locking fingers with a binder, FIGS. 4–11 depict the engagement operation of a section of looseleaf binder sheet 20 about a single ring binder 40. However, as is readily apparent from this description, the entire dual-function looseleaf binder sheet 20 of the present invention would be securely mounted to any fastener in an identical fashion regardless of the number of binder-receiving holes incorporated on the looseleaf sheet.

Figure 4:
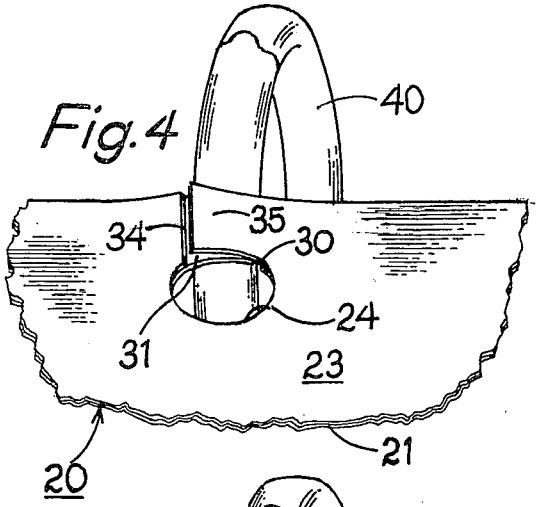
FIGS. 4–7 are enlarged perspective views of a section of the looseleaf binder sheets of the present invention showing, in sequence, the operation of the looseleaf binder sheet of the present invention being inserted into locked engagement with a ring binder without opening the ring binder.
Figure 5:
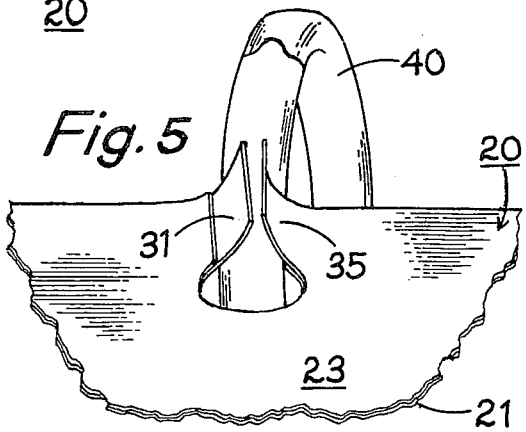
Figure 8:
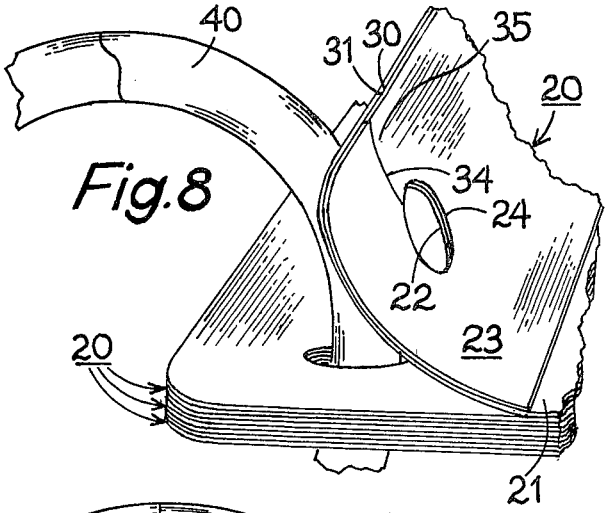
FIGS. 8–11 are enlarged perspective views of a section of dual-function, looseleaf binder sheets of the present invention showing comparable sequential, paper insertion steps depicted in FIGS. 4–7, as viewed from the bottom edge of the sheets.
Figure 9:
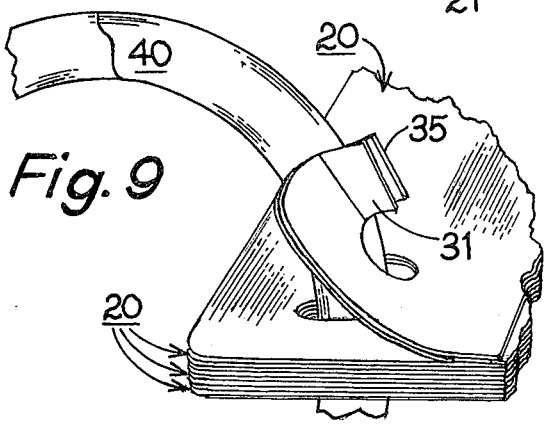

In FIGS. 4 and 8, dual-function, looseleaf binder sheet 20 of the present invention is shown in its initial stages of mounting engagement with ring binder 40. As shown therein, as forces are applied to sheet 20 which are acting substantially coaxially with the central axis of concentrically aligned binder-receiving holes 22 and 24, or at acute angles thereto, overlapping flexible binder-locking fingers 35 and 31 begin to spread away from their respective finger forming slits 34 and 30. As additional force is applied, flexible binder locking fingers 31 and 35 continue to spreadingly disengage from their overlapping relationship until separated, as shown in FIGS. 5 and 9.

Figure 6:
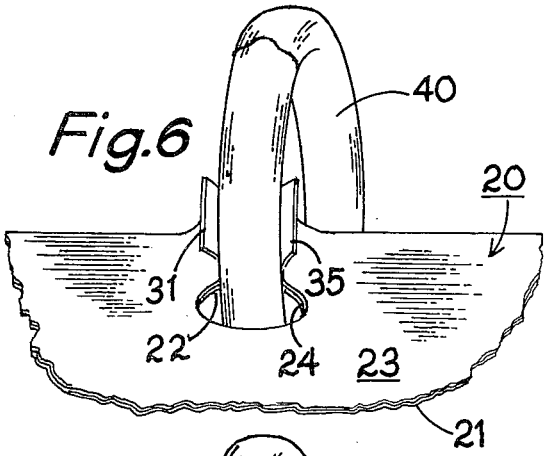
Figure 10:
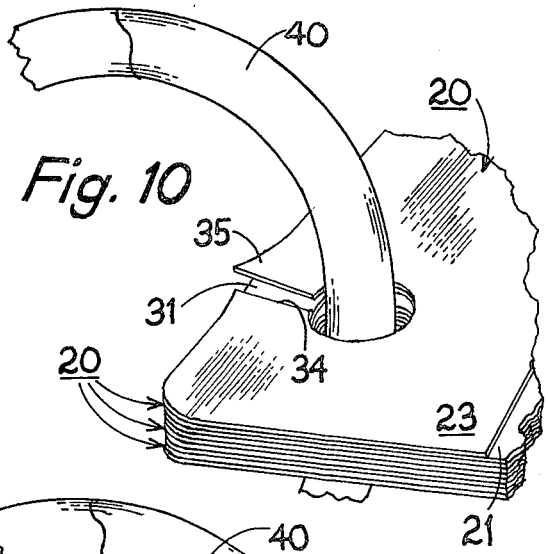

Then, as shown in FIG. 6, the application of additional paper insertion force causes flexible binder-locking fingers 31 and 35 to slide over the surface of ring binder 40 moving from engagement with its outside diameter to engagement with its inside diameter, causing coaxially aligned binder-receiving holes 22 and 24 to peripherally surround binder ring 40. In FIG. 10, dual function, looseleaf binder sheet 20 is shown in the last stage prior to final completed engagement with ring binder 40, wherein flexible binder-locking finger 35 is depicted approaching complete overlapping juxtaposed cooperating engagement with underlying flexible binder locking finger 31, with binder locking finger 35 also approaching abutment with slit 34.

Figure 7:
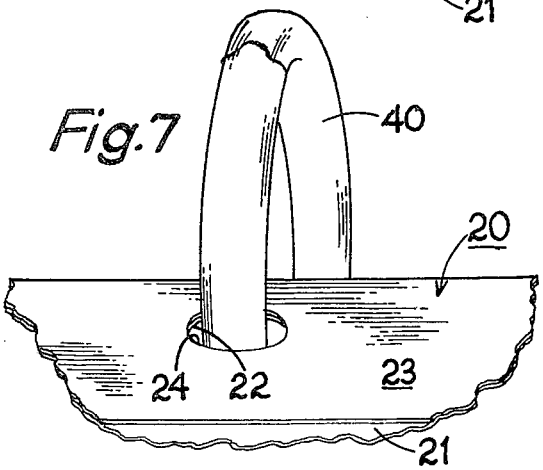
Figure 11:
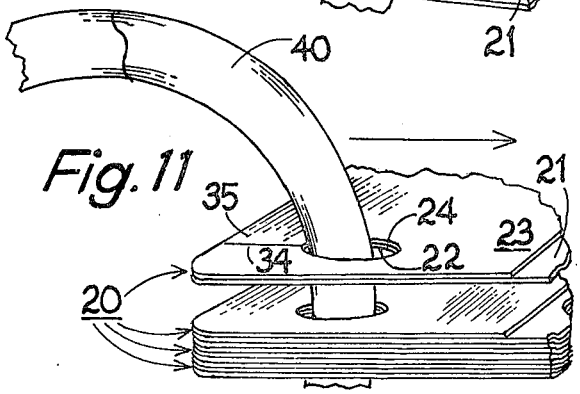

In FIGS. 7 and 11, the dual function looseleaf binder sheet 20 of the present invention is shown in its fully engaged position with ring fastener 40, with FIG. 11 clearly depicting the secure retained engagement of sheet 20 with ring binder 40 when forces acting upon sheet 20 are imposed substantially coplanar with sheet 20. When any such coplanar forces are imposed upon sheet 20, the side edges of binder locking fingers 35 and 31 directly abut the surface of binder 40, exerting a lateral force on binder-locking fingers 31 and 35. Since the flexibility inherent in binder-locking fingers 31 and 35 is in response to forces acting substantially perpendicular to fingers 31 and 35, fingers 31 and 35 remain stationary against these lateral forces, thereby securely retaining sheets 20 in locked engagement with ring binder 40. In this way, the dual function of both locked engagement and quick and easy withdrawal of a looseleaf binder sheet 20 is achieved.

It will thus be seen that the objects set forth above among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A looseleaf binder sheet for mounting in looseleaf binders incorporating binder means, with each looseleaf binder sheet capable of being securely maintained in locked engagement with the binder means as well as easily removed therefrom when desired without tearing or ripping the sheet and without opening of the binder means, each looseleaf binder sheet comprising:

A. a binder-engaging section incorporating
  (1) at least two layers formed therealong each layer having a coinciding free, exposed edge, and
  (2) a plurality of binder-receiving holes
    (a) positioned along the binder engaging section inwardly spaced from the free, exposed edge thereof in substantial alignment, and
    (b) formed through the plurality of layers;

B. a set of cooperating, juxtaposed, overlapping oppositely extending binder-locking fingers each having its terminating end defined by a slit in the binder-engaging section extending between the free, exposed edge thereof and each binder-receiving hole; and C. each of said sets of binder-locking fingers comprising a single binder-locking finger in each of the layers, and the finger-end-defining slit in each of said layers being non-coincidingly offset from the finger-end-defining slit in the adjacent layer whereby the plurality of sets of binder-locking fingers securely maintain the looseleaf binder sheet engaged with the binder means in response to forces acting in the plane of the looseleaf binder sheet, while allowing the looseleaf binder sheet to be quickly and easily removed from engagement with the binder means in response to forces acting substantially perpendicular to the plane of the looseleaf binder sheet, or at an acute angle thereto, by the flexible, spreading disengagement of the binder-locking fingers in response to said force.

2. The looseleaf binder sheet defined in claim 1, wherein each of said layers are further defined as being securely affixed to each other along areas adjacent the binder-engaging holes.

3. The looseleaf binder sheet defined in claim 1, wherein at least one of said layers comprises a single, elongated reinforcing strip fastened to the adjacent layer by glue means in zones formed between the binder-receiving holes.

4. The looseleaf binder sheet defined in claim 1, wherein at least one of said layers comprises paper material and at least another of said layers comprises plastic sheet material, thereby imparting added stiffness and rigidity to the binder-locking fingers formed therefrom.

5. The looseleaf binder sheet defined in claim 1, wherein the finger-forming slits in each layer are offset from the slits of each adjacent layer, thereby providing overlapping, cooperating, juxtaposed binder-locking fingers having terminating ends formed on opposite sides of the binder-engaging hole.

6. The looseleaf binder sheet defined in claim 1, wherein
  (1) the finger-forming slit of the first of said layers is defined as extending radially from each binder-engaging hole to the edge of the binder-engaging section, joining therewith at an acute angle, and
  (2) the finger-forming slits of the second layer extend from each binder-engaging hole to the edge of the binder-engaging section, joining therewith at an acute angle, and also having a slope opposite to the slope of the slits in the first layer, thereby establishing overlapping, cooperating, juxtaposed, binder-locking fingers having terminating ends on opposite sides of the binder-engaging hole.

7. The looseleaf binder sheet defined in claim 1, wherein the finger-forming slits of each layer extend substantially perpendicularly from the edge of the binder-engaging section to each binder-engaging hole, with the finger-forming slits of the first layer extending towards one tangential edge of the binder-receiving hole and the finger-forming slits of the second layer extending to the diametrically opposed tangential edge of the binder-engaging hole.

8. The looseleaf binder sheet defined in claim 1, wherein the finger-forming slits of one layer extend substantially perpendicularly from the edge of the binder-engaging section to the binder-engaging hole and the finger-forming slits of the second layer extend radially from the opposite side of the binder-engaging hole to the edge of the binder-engaging section joining therewith at an acute angle, thereby providing overlapping, cooperating, juxtaposed binder-locking fingers having terminating ends at opposite sides of the binder-engaging hole.

* * * * *